US005577424A

United States Patent [19]

Isobe et al.

[11] Patent Number: 5,577,424

[45] Date of Patent: Nov. 26, 1996

[54] NITROGEN-CONTAINING SINTERED HARD ALLOY

[75] Inventors: Kazutaka Isobe; Keiichi Tsuda; Nobuyuki Kitagawa; Toshio Nomura, all of Itami, Japan

[73] Assignee: Sumitomo Electric Industries, Ltd., Osaka, Japan

[21] Appl. No.: 313,222

[22] PCT Filed: Feb. 3, 1994

[86] PCT No.: PCT/JP94/00158

§ 371 Date: Mar. 28, 1995

§ 102(e) Date: Mar. 28, 1995

[87] PCT Pub. No.: WO94/18351

PCT Pub. Date: Aug. 18, 1994

[30] Foreign Application Priority Data

Feb. 5, 1993 [JP] Japan ..... 5-018283
Dec. 22, 1993 [JP] Japan ..... 5-323917

[51] Int. Cl.[6] ..... C22C 19/00
[52] U.S. Cl. ..... 75/236; 75/238; 75/245
[58] Field of Search ..... 75/236, 238, 245

[56] References Cited

U.S. PATENT DOCUMENTS 4,049,876 9/1977 Yamamoto et al. ..... 428/932
4,277,283 7/1981 Tobioka et al. ..... 75/238
4,497,874 2/1985 Hale ..... 428/551
4,548,786 10/1985 Yohe ..... 419/29
4,610,931 9/1986 Nemeth et al. ..... 428/547
4,830,930 5/1989 Taniguchi et al. ..... 428/547
4,913,877 4/1990 Yohe ..... 419/13
4,971,485 11/1990 Nomura et al. ..... 408/144
5,181,953 1/1993 Nakano et al. ..... 75/237
5,283,030 2/1994 Nakano et al. ..... 419/53

FOREIGN PATENT DOCUMENTS 0515340 11/1992 European Pat. Off. .
0519895 12/1992 European Pat. Off. .
2-15139 1/1990 Japan .

*Primary Examiner*—Charles T. Jordan
*Attorney, Agent, or Firm*—Wenderoth, Lind & Ponack

[57] ABSTRACT

A nitrogen-containing sintered hard alloy in which the content of the binder phase is at the highest level in an area to a depth of between 3 μm and 500 μm from its surface and its content in this area is between 1.1 and 4 times the average content of the binder phase in the entire alloy. Below this area, the content of the binder phase decreases gradually so that its content becomes equal to the average content of the binder phase at a depth of 800 μm or less. The content of the binder phase in the surface layer is 90% or less of its maximum value. The depth of 800 μm is a value at which the thermal conductivity is kept sufficiently high and at the same time a tool can keep high resistance to plastic deformation during cutting.

19 Claims, 4 Drawing Sheets

Near-surface portion in Co line analysis with EPMA

NITROGEN-CONTAINING SINTERED HARD ALLOY

TECHNICAL FIELD

This invention relates to a nitrogen-containing sintered hard alloy which possesses excellent thermal shock resistance, wear resistance and toughness and which shows exceptionally favorable properties when used as a material for cutting tools.

Background Art

There are already known cutting tools that are formed of a nitrogen-containing sintered hard alloy having hard phases of carbonitrides or the like composed mainly of Ti and bonded together through a metal phase made up of Ni and Co. Such a nitrogen-containing sintered hard alloy is extremely small in particle size of the hard phases compared to a conventional sintered hard alloy that contains no nitrogen, so that it shows much improved high-temperature creep resistance. Because of this favorable property, this material has been used for cutting tools as widely as what is known as cemented carbides, which are composed mainly of WC.

But nitrogen-containing sintered hard alloys are low in thermal shock resistance. This is because (1) its main component, Ti carbonitride, is extremely low in thermal conductivity compared to WC, the main component of a cemented carbide, so that the thermal conductivity as the entire alloy is about half that of a cemented carbide, and (2) its thermal expansion coefficient, which also largely depends upon that of main component, is 1.3 times that of a cemented carbide. Therefore, cutting tools made of such an alloy have not been used with reliability under conditions where the tools are subjected to severe thermal shocks such as for milling, lathing of square materials or for wet copy cutting where the depth of cut changes widely.

The present inventors have analyzed various phenomena associated with cutting operations such as the temperature and stress distributions in cutting tools in different cutting types and Studied the relation between such phenomena and the arrangement of components in the tool. As a result, they achieved the following findings. A cemented carbide, which has a high thermal conductivity, is less likely to heat up because the heat produced at the tool surface during cutting diffuses quickly through the tool body. Also, due to its low thermal expansion coefficient, tensile stresses are less likely to be produced and remain at the surface area even if the tool begins idling abruptly or the high-temperature portion is brought into contact with a water-soluble cutting oil and thus is cooled sharply.

In contrast, nitrogen-containing sintered hard alloys composed mainly of Ti show a sharp temperature gradient during cutting due to its low thermal conductivity. Namely, heat is difficult to diffuse from the areas where the temperature is the highest during cutting, such as the tip of the cutting edge and a portion of the rake face where chips collide, so that the temperature is high at the surface but is much lower at the inside. Once such an alloy gets a crack, it can be broken very easily because of low inner temperature. Conversely, if such an alloy is cooled sharply by contact with a cutting oil, the temperature gradient is reversed, that is, only the surface area is cooled sharply while the temperature at the inner portion directly thereunder remains high. Due to this fact and high thermal expansion coefficient, tensile stresses tend to be produced at the surface area, which dramatically increases the possibility of thermal cracks. Namely, it was difficult to sufficiently improve the thermal conductivity and thermal expansion coefficient of nitrogen-containing sintered hard alloys which contain Ti, a component necessary for a good surface finish. The inventors have carried out extensive studies for solutions to these problems and reached the present invention.

DISCLOSURE OF THE INVENTION

The nitrogen-containing sintered hard alloy according to the present invention has a Ti-rich layer at a superficial layer which determines the characteristics of the cut surface finish, and with a predetermined thickness provided right under the superficial layer a layer rich in binding metals such as Ni and Co. Since the Ni/Co-rich layer has a high thermal expansion coefficient, this layer serves to impart compressive stresses to the surface layer when cooled after sintering or detaching the cutting tool. Besides, tungsten, an essential component of the hard phase, should be rich inwardly from the surface. By gradually increasing the W content inwardly, the hard phase serves to increase the thermal conductivity of the alloy, especially in the inner area thereof, though it is the binder phase that mainly serves this purpose. Namely, since the binder phase is present in a smaller amount and the hard phase in a larger amount in the deeper area of the binder phase-rich layer, it is possible to improve the thermal conductivity effectively.

More particularly, the nitrogen-containing sintered hard alloy of the present invention is characterized in that the content of the binder phase is at the highest level in an area to a depth of between 3 μm and 500 μm from its surface and its content in this area should be between 1.1 and 4 times the average content of the binder phase in the entire alloy. Below this area, the content of the binder phase should decrease gradually so that its content becomes equal to the average content of the binder phase at a depth of 800 μm or less. The content of the binder phase in the surface layer is 90% or less of its maximum value. The depth of 800 μm is a value at which the thermal conductivity is kept sufficiently high and at the same time the tool can keep high resistance to plastic deformation. during cutting. As for the hard phase, we have discovered that Ti, as well as Ta, Nb and Zr, which can improve the wear resistance of the alloy when cutting steel materials to a similar degree as Ti, should be present in greater amounts in the surface area, and instead, W and Mo should be present in smaller amounts in the surface area. In particular, W should not be present in the surface area as WC particles or should be present in the amount of 0.1 volume % or less. The hard phase is made up of at least one of caribides, nitrides, carbonitrides and compositions thereof of at least two transition metals that belong in Groups IVb, Vb and VIb of the Periodic Table.

We will now discuss reasons why the above conditions are necessary:

(1) Range of depth of the layer in which the content of binder phase is at the highest level and the maximum content The binder phase-rich region is necessary to increase the tool strength and to produce compressive stresses in the surface layer when the cutting tool cools after sintering and when it is detached. If the depth of the binder phase-rich layer is less than 3 μm, the tool's wear resistance will be insufficient. If more than 500 μm, it would be difficult to produce a sufficiently large compressive stress in the surface layer. If the ratio of the highest content of the binder phase to the average binder phase content is 1.1 or less, no desired tool strength would be attainable. If the ratio exceeds 4, the tool might suffer plastic deformation when cutting or it might get too hard at its inner area to keep sufficiently high tool strength.

(2) Content of binder phase in the surface layer

The surface layer has to be sufficiently wear-resistant and also has to have a smaller thermal expansion coefficient than the inner area so that compressive stresses are applied to the surface layer. Should the ratio to the highest binder phase content exceed 0.9, these effects would not appear.

(3) Contents of Ti, Ta, Nb and Zr in the surface layer

The surface layer has to have high wear resistance and thus has to contain in large amounts not only Ti but Ta, Nb and Zr, which can improve the wear resistance of the material as effectively as Ti. If the ratio of X at the surface to the average X value of the entire alloy is less than 1.01, no desired wear resistance is attainable. Ta and Nb are especially preferable because these elements can also improve the high-temperature oxidation resistance. By providing the surface layer rich in these elements, it is possible to improve various properties of the finished surface.

(4) W and Mo contents in the hard phase in the surface layer

The contents of W and Mo in the hard phase are represented by y and b in the formulas ($Ti_x W_y M_c$) and ($Ti_x W_y Mo_b M_c$).

The surface layer should contain WC and/or $Mo_2C$ in smaller amounts because these elements are low in wear resistance. Eventually, the amounts of W and/or Mo in the inner hard phase are greater. It is practically impossible to prepare a material that contains W so that the ratio of Y in the surface to y in the entire alloy will be less than 0.1. If this ratio exceeds 0.9, the wear resistance will be too low to be acceptable. Mo behaves in the hard phase in substantially the same way as WC.

Now focusing on WC only, W in the hard phase, which increases in amount inwardly of the alloy from its surface, may be present in the form of WC particles or may be present at the peripheral region of complex carbonitride solid solutions. In the hard phase, the W-rich solid solutions may partially appear or may be greater in amount than the surface. It is also possible to improve the thermal conductivity and strength by increasing the ratio of hard particles having a white core and a dark-colored peripheral portion when observed under a scanning electron microscope (such particles are called white-cored particles; the white portions are rich in W, while the dark-colored portions are poor in W). The values x and y have to be within the ranges of $0.5<X\leqq 0.95$, $0.05<Y\leqq 0.5$ in order to maintain high wear resistance and heat resistance. Out of these ranges, both the wear resistance and heat resistance will drop to a level at which the object of the present invention is not attainable.

As a result of extensive studies in search of means to improve the thermal shock resistance, wear resistance and toughness, the present inventors have discovered that it is most effective to impart compressive residual stresses to the surface area of a nitrogen-containing sintered hard alloy. As discussed above, tensile stress acts on the surface area of a nitrogen-containing sintered hard alloy with changing thermal environment. If this stress exceeds the yield strength of the sintered hard alloy itself, cracks (thermal cracks) will develop, thus lowering the strength of the nitrogen-containing sintered hard alloy. Such an alloy is destined to be broken sooner or later. From the above discussion, it means that the best way to improve the thermal shock resistance is to improve its yield strength.

The most effective way to improve the yield strength of a nitrogen-containing sintered hard alloy is to impart compressive residual stresses to its surface region. Before discussing the detailed structure and mechanism for imparting compressive residual stresses, we would like to point out the fact that by imparting compressive residual stresses, it is possible not only to improve the thermal shock resistance of a nitrogen-containing sintered hard alloy but to significantly improve its wear resistance and toughness when compared to conventional alloys of this type.

The nitrogen-containing sintered hard alloy according to the present invention is heated under vacuum. Sintering (at 1400° C.–1550° C.) is carried out in a carburizing or nitriding atmosphere to form a surface layer comprising a Ti-rich hard phase with zero or a small amount of binder phase. The alloy is then cooled in a decarburizing atmosphere so that the volume percentage of the binder phase will increase gradually inwards from the surface of the alloy. By controlling the cooling rate to 0.05–0.8 times the conventional cooling rate, it is possible to increase the content of binder phase rapidly inwards from the surface and thus to impart desired compressive residual stresses to the surface area.

In this arrangement, since the surface area is composed only of a Ti-based hard phase (or such a hard phase plus a small amount of a metallic phase), the alloy shows excellent wear resistance compared to conventional nitrogen-containing sintered hard alloys. Its toughness is also superior because the layer right under the surface area is rich in binder phase.

Also, we have discovered that by sintering a material powder containing 10 wt % or more WC in a nitriding atmosphere, it is possible to form a nitrogen-containing sintered hard alloy in which WC particles appear with the WC volume percentage increasing toward the average WC volume percentage from the alloy surface inwards. Since the surface area is for the most part composed of the Ti-based hard phase, the alloy is sufficiently wear-resistant. Also, the WC particles present right under the alloy surface allow smooth heat dispersion and thus reduce thermal stress. Such WC particles also serve to increase the Young's modulus and thus the toughness of the entire nitrogen-containing sintered hard alloy. In the nitrogen-containing sintered hard alloy according to the present invention, metallic components or metallic components and WC may ooze out of the alloy surface in small quantities. But the surface layer formed by such components will have practically no influence on the cutting performance because the thickness of such a layer does not exceed 5 μm.

As discussed above, by applying compressive residual stresses to the surface area, it is possible to increase the yield strength of the entire alloy. The present inventors have also discovered that by controlling such compressive residual stresses at 40 $kg/mm^2$ or more in the hard phase at the surface layer, the thermal shock resistance increases to a level higher than that of a conventional nitrogen-containing sintered hard alloy and comparable to that of a cemented carbide.

Also, compressive residual stresses greater than the stresses at the outermost surface area should preferably be applied to the intermediate area from the depth of 1 μm to 100 μm from the surface. With this arrangement, even if deficiencies should develop in the outermost area, the compressive stresses applied to the intermediate area will suppress the propagation of cracks due to deficiencies, thereby preventing the breakage of the alloy itself. In order to distribute stresses in the above-described manner, the binder phase has to be distributed as shown in FIG. 5. Namely, by distributing the binder phase as shown in FIG. 5, stresses are distributed as shown in FIG. 6.

By setting the maximum compressive residual stress at a value 1.01 times or more greater than the compressive residual stresses in the uppermost area, it is possible to prevent the propagarion of cracks very effectively, provided the above-mentioned conditions are all met. By setting this maximum value at 40 kg/mm$^2$ or more, the alloy shows resistance to crack propagation comparable to that of a cemented carbide. But, as will be inferred from FIGS. 5 and 6, if the maximum compressive residual stress were present at a depth of more than 100 μm compressive residual stresses in the uppermost area would decrease. This is not desirable because the thermal shock resistance unduly decreases. Also, a hard and brittle surface layer that extends a width of more than 100 μm would reduce the toughness of the alloy.

Thus, an area containing 5% by volume or less of the binder phase should be present between the depth of 1 μm and 100 μm. With this arrangement, the alloy would show excellent wear resistance while not resulting any decrease in toughness.

Preferably, the area in which the content of the binder phase is zero or not more than 1% by volume should have a width of between 1 μm and 50 μm (see FIG. 7).

The present inventors have studied the correlation between compressive residual stresses and the distribution of the binder phase from the alloy surface inwards and discovered that the larger the content gradient of the metallic binder phase (the rate at which the content increases inwardly per unit distance), the larger the compressive residual stress near the point at which the content of the binder phase begins to increase (see FIG. 7).

Further studies also revealed that, in order for the alloy to have a thermal shock resistance comparable to that of a cemented carbide, the inward content gradient of the binder phase (the rate at which the content of the binder phase increases per micrometer) should be 0.05% by volume or higher. Also, in order for the alloy to have higher wear resistance and toughness than conventional nitrogen-containing sintered hard alloys, the content of the binder phase in the area between the surface of the alloy and the point at which it begins to increase should be 5% by volume or less, and also such an area has to have a width between 1 μm and 100 μm.

By distributing WC particles in the alloy so that its content is higher in the inner area of the alloy than in the surface area, it is possible to improve the toughness in the inner area of the alloy while keeping high wear resistance intrinsic to Ti in the surface area. For higher wear resistance, the WC content in the area from the surface to the depth of 50 μm should be limited to 5% by volume or less. The alloy containing WC particles shows improved thermal conductivity. Its thermal shock resistance is also high compared to a nitrogen-containing sintered hard alloy containing no WC particles. Moreover, such an alloy is less likely to get broken because of improved Young's modulus.

Thus, by forming cutting tools from the alloys according to the present invention, it is possible to increase the reliability of such tools even if they are used under cutting conditions where they are subjected to severe thermal shocks such as in milling, lathing of square materials or for wet copy cutting where the depth of cut changes widely.

Since the nitrogen-containing sintered hard alloy according to the present invention has high thermal shock resistance comparable to that of a cemented carbide, it will find its use not only for cutting tools but as wear-resistant members.

BEST MODE FOR EMBODYING THE INVENTION

Example 1

Figure 1:
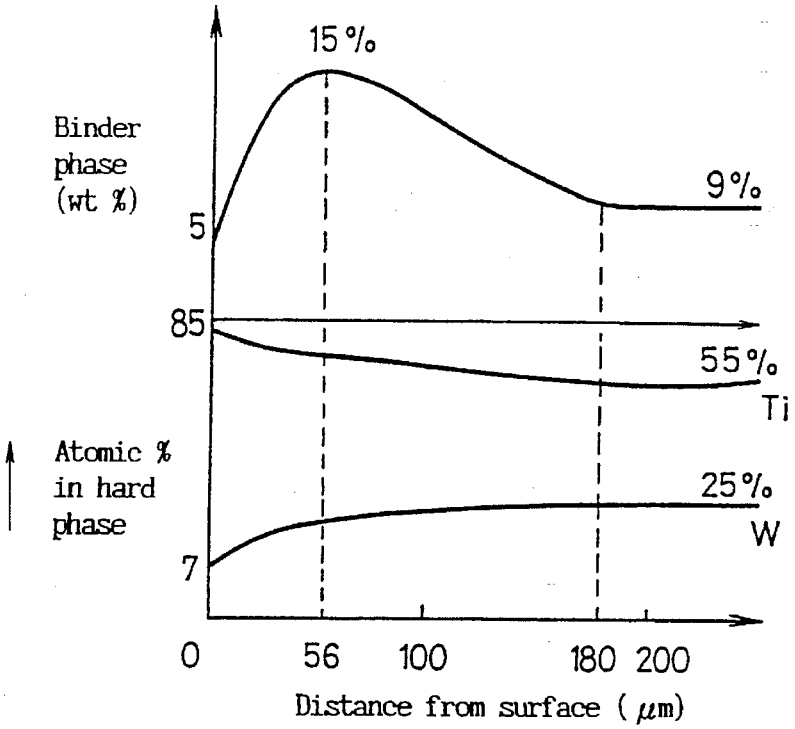
FIG. 1 is a graph showing the distribution of components in Specimen 1 in Example 1 according to the present invention, with distance from its surface in the direction of depth.
Figure 2:
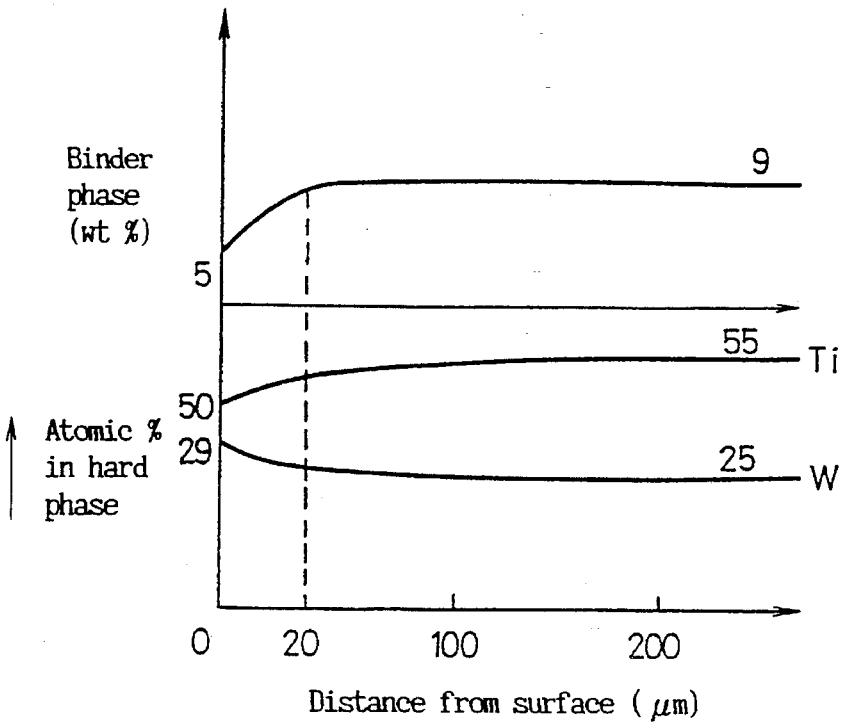
FIG. 2 is a similar graph of Specimen 2 in Example 1.
Figure 3:
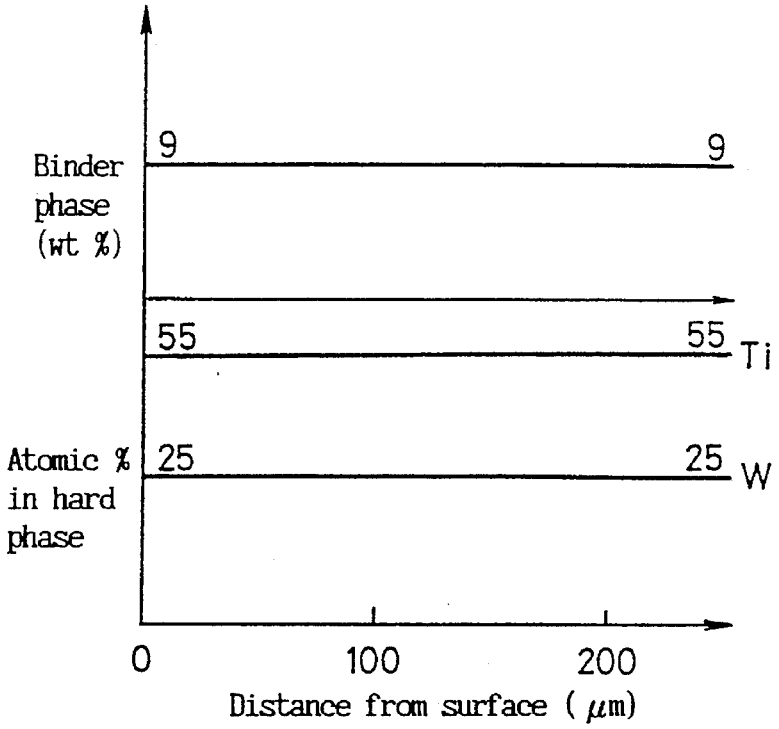
FIG. 3 is a similar graph of Specimen 3 in Example 1.
Figure 4:
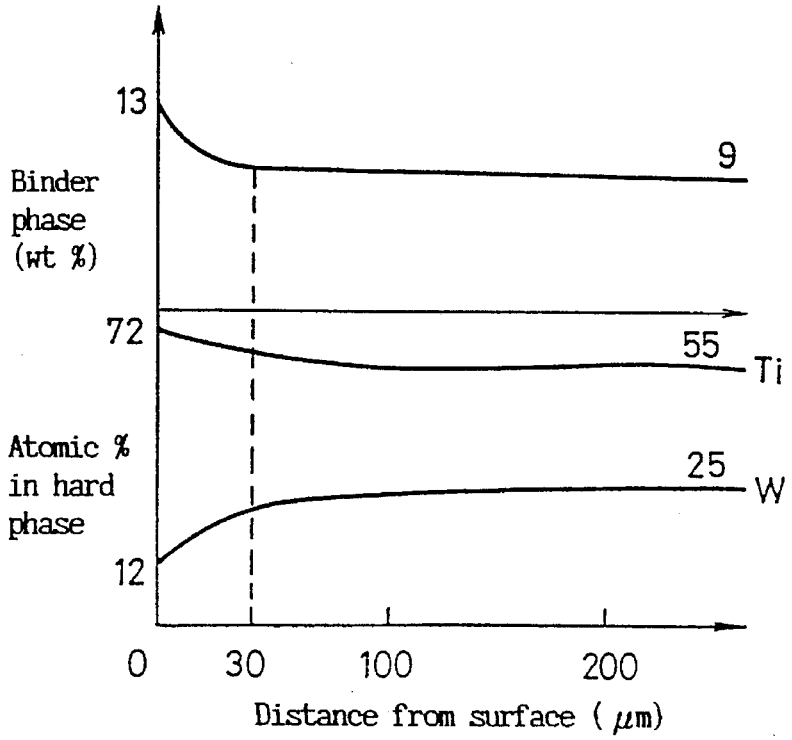
FIG. 4 is a similar graph of Specimen 4 in Example 1.
Figure 5:
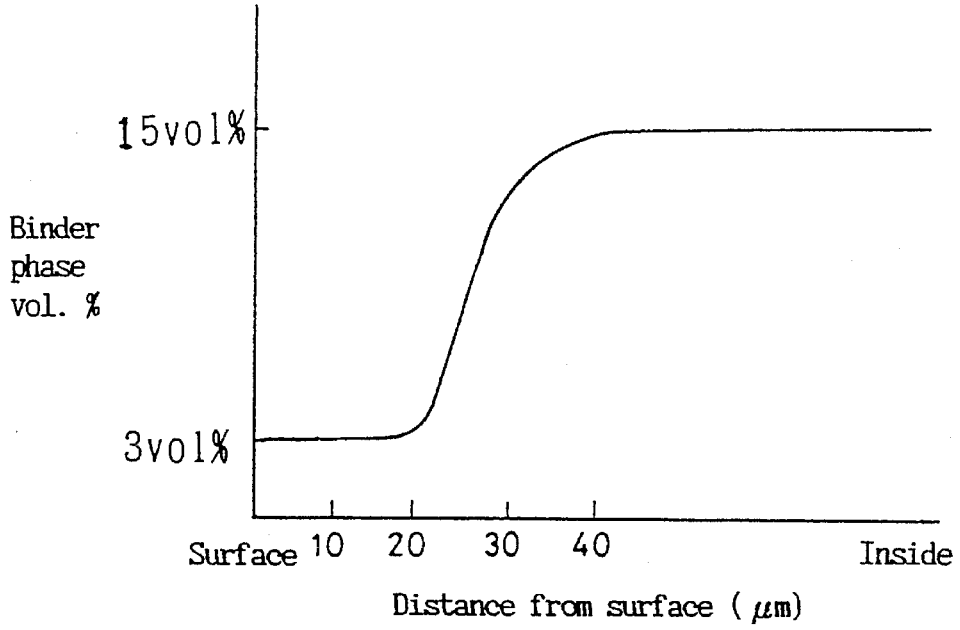
FIG. 5 is a graph showing one example of distribution of the binder phase in an alloy according to the present invention.
Figure 6:
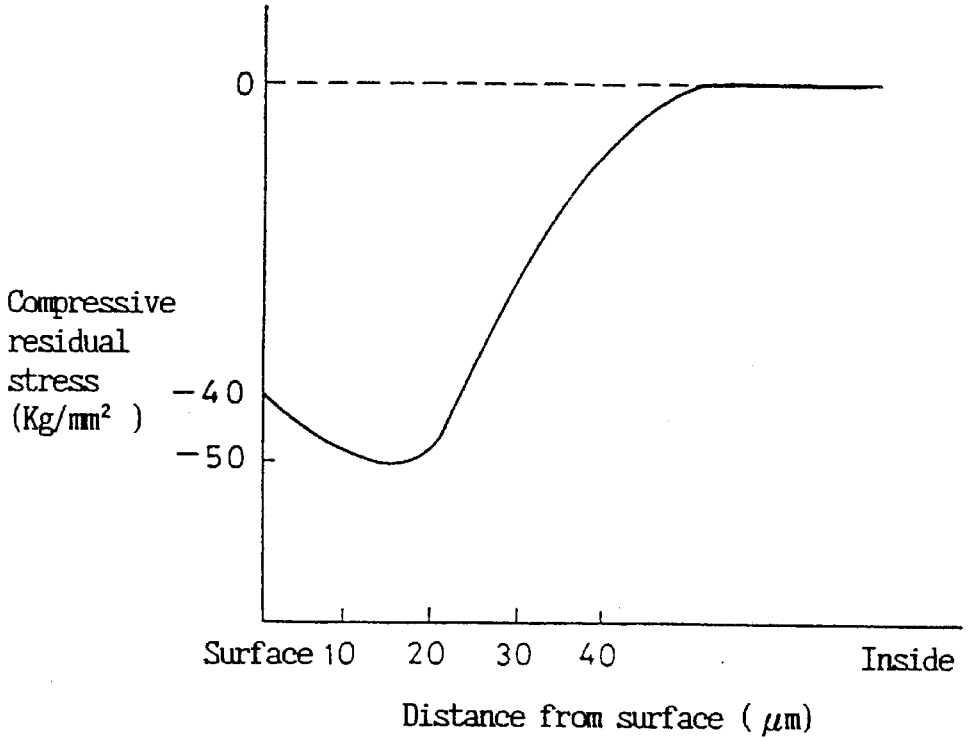
FIG. 6 is a graph showing the distribution of compressive residual stress in the binder phase shown in FIG. 5.
Figure 7:
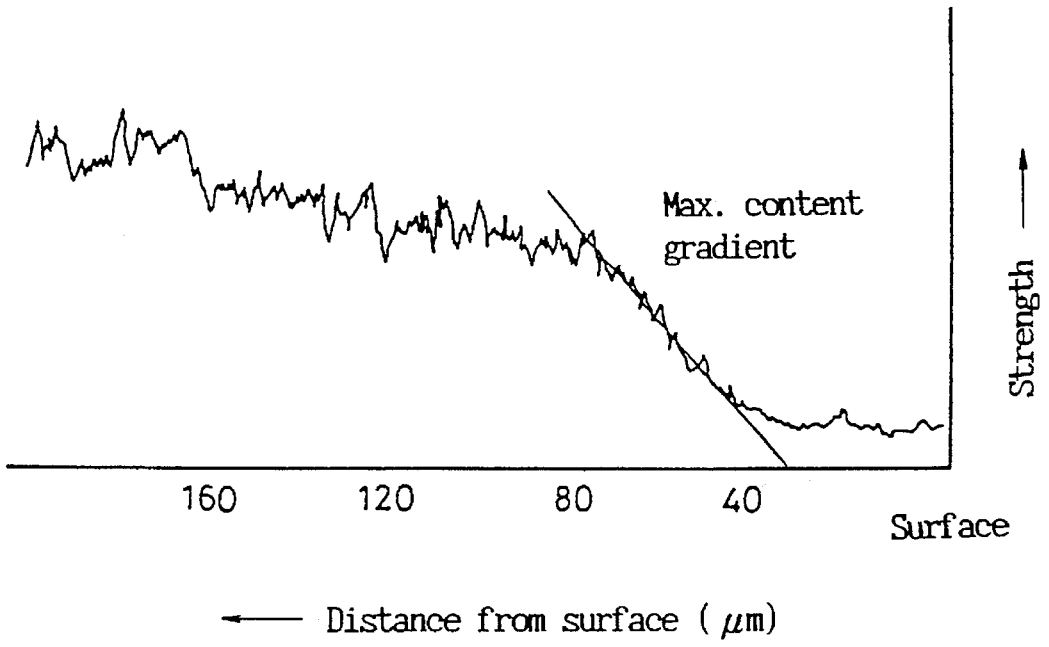
FIG. 7 is a graph showing the relation between the distribution of Co as the binder phase and the strength.

A powder material made up of 48% by weight of $(Ti_{0.8}W_{0.2})(C_{0.7}N_{0.3})$ powder having an average particle diameter of 2 μm, 24% by weight of (TaNb)C powder (TaC: NbC=2:1 (weight ratio)) having an average particle diameter of 1.5 μm, 19% by weight of WC powder having an average particle diameter of 4 μm, 3% by weight of Ni powder and 6% by weight of Co powder, both having an average particle diameter of 1.5 μm, were wet-mixed, molded by stamping, degassed under a vacuum of $10^{-2}$ Torr at 1200° C., heated to 1400° C. at a nitrogen gas partial pressure of 5 Torr and a hydrogen gas partial pressure of 0.5 Torr, and sintered for one hour first under a vacuum of $10^{-2}$ Torr and then in a gaseous atmosphere. The material sintered was cooled quickly with nitrogen to 1330° C. and then cooled gradually at the rate of 2° C./min while supplying $CO_2$ at 100 Torr. Specimen 1 was thus obtained. Its structure is shown in Table 1.

For comparison purposes, we also prepared three additional Specimens 2–4 using conventional process. Namely, Specimen 2 was formed by sintering the same stamped molding as in Specimen 1 at 1400° C. under a nitrogen partial pressure of 5 Torr. Specimen 3 was formed by sintering the same stamped molding in the same manner as with Specimen 2 and further cooling it at a CO partial pressure of 200 Torr. Specimen 4 was formed by sintering the same stamped molding in the same manner as with Specimen 2 and further cooling it at a nitrogen partial pressure of 180 Torr. Table 2 show their structures.

Specimens 1–4 were actually used for cutting under three different cutting conditions shown in Table 3 and tested for the three items shown in Table 3. The test results are shown in Table 4.

Example 2

A powder material made up of 51% by weight of $(Ti_{0.8}W_{0.2})(C_{0.7}N_{0.3})$ powder having an average particle diameter of 2 μm, 27% by weight of (TaNb)C powder (TaC: NbC=2:1 (weight ratio)) having an average particle diameter of 1.2 μm, 11% by weight of WC powder having an average particle diameter of 5 μm, 3% by weight of Ni powder and 8% by weight of Co powder, both having an average particle diameter of 1.5 μm, were wet-mixed, molded by stamping, degassed under a vacuum of $10^{-2}$ Torr at 1200° C., and sintered for one hour at 1450° C. under a nitrogen gas partial pressure of 10 Torr. Specimen 5 was obtained by cooling the thus sintered material under a high vacuum of $10^{-5}$ Torr.

Specimen 6 was formed by cooling the same sintered molding in $CO_2$.

For comparison purposes, we also prepared from the same stamped moldings Specimens 7 and 8 having the structures shown in Table 5. These specimens were subjected to actual cutting tests under the cutting conditions shown in Table 6. The test results are shown in Table 7.

Example 3

A powder material made up of 42% by weight of $(Ti_{0.8}W_{0.2})(C_{0.7}N_{0.3})$ powder having an average particle diameter of 2.5 μm, 23% by weight of (TaNb)C powder (TaC: NbC =2:1 (weight ratio)) having an average particle diameter of 1.5 μm, 25% by weight of WC powder having an average particle diameter of 4 μm, 2.5% by weight of Ni powder and 6.5% by weight of Co powder, both having an average particle diameter of 1.5 μm, were wet-mixed, molded by stamping, and sintered for one hour at 1430° C. under a nitrogen gas partial pressure of 15 Torr. Specimen 9 was obtained by cooling the thus sintered material in $CO_2$. Specimen 10 was formed by cooling the same sintered material in hydrogen gas having a dew point of −40° C.

For comparison purposes, we also prepared from the same powder material Specimens 11–13 so that the average content of binder phase and content of hard phase (Ti +Nb, W) will be as shown in Table 8. We also prepared other Specimens 14–19, which have different structures from Specimens 9 and 10 though they were formed from the same stamped molding as Specimens 9 and 10. These specimens were subjected to actual cutting tests under the cutting conditions shown in Table 9. The test results are also shown in Table 9.

Example 4

We prepared a powder material made up of 85% by weight of $(Ti_{0.75}Ta_{0.04}Nb_{0.04}W_{0.17})(C_{0.56}N_{0.44})$ having a black core and a white periphery as observed under a reflecting electron microscope and having an average particle diameter of 2 μm, 8% by weight of Ni powder and 7% by weight of Co powder, both having an average particle diameter of 1.5μm. The powder materials thus prepared were wet-mixed, molded by stamping, degassed at 1200° C. under vacuum of $10^{-2}$ Torr, and sintered for one hour at 1450° C. under a nitrogen gas partial pressure of 10 Torr, and cooled in $CO_2$. Specimen 20 was thus obtained. Specimen 21 was formed by mixing Ti(CN), TaC, WC, NbC, Co and Ni so that the mixture will have the same composition as Specimen 20 and sintering the mixture.

For comparison purposes, we also prepared Specimens 22 and 23 having structures shown in Table 10 from the same molding as used in forming Specimen 20, and Specimen 24 having a structure shown in Table 10 from the same molding as used in forming Specimen 21. These specimens were subjected to actual cutting tests under the cutting conditions shown in Table 11. The test results are also shown in Table 11.

Example 5

We prepared alloy specimens having average compositions and structures as shown in Table 12 from $(Ti_{0.8}W_{0.2})(C_{0.7}N_{0.3})$ powder having an average particle diameter of 2. μm, TaC powder having an average particle diameter of 1.5 μm, WC powder having an average particle diameter of 4 μm, ZrC powder having an average particle diameter of 2 μm, and Ni powder and Co powder, both having an average particle diameter of 1.5 μm. Table 13 shows the properties of the respective alloy specimens.

Example 6

We prepared alloy specimens having average compositions and structures as shown in Table 14 from $(Ti_{0.8}W_{0.2})(C_{0.7}N_{0.3})$ powder having an average particle diameter of 2 μm, TaC powder having an average particle diameter of 5 μm, NbC powder having an average particle diameter of 3 μm, WC powder having an average particle diameter of 4 μm, $Mo_2C$ powder having an average particle diameter of 3 μm, and Ni powder and Co powder, both having an average particle diameter of 1.5 μm. Table 15 shows the properties of the respective alloy specimens.

Example 7

We prepared the following material powders (a)–(f): (a) 82% by weight of $(Ti_{0.7}, W_{0.2}, Nb_{0.05}, Ta_{0.05})(C_{0.7}, N_{0.3})$ powder having an average particle diameter of 1.5 μm, 12% by weight of Ni powder having an average particle diameter of 1.5 μm, and 6% by weight of Co powder having an average particle diameter of 1.5 μm (b) 49% by weight of $(Ti_{0.9}, W_{0.05}, Nb_{0.025}, Ta_{0.025})(C_{0.7}, N_{0.3})$ powder having an average particle diameter of 1.5 μm, 37% by weight of WC powder having an average particle diameter of 2 μm, and Ni powder and Co powder, 7% by weight each, both having an average particle diameter of 1.5 μm (c) 82% by weight of $(Ti_{0.6}, W_{0.2}, Nb_{0.2})(C_{0.7}, N_{0.3})$ powder having an average particle diameter of 1.5 μm, and Ni powder and Co powder, 9% by weight each, both having an average particle diameter of 1.5m (d) 49% by weight of $(Ti_{0.8}, W_{0.1}, Nb_{0.1})(C_{0.4}, N_{0.6})$ powder having an average particle diameter of 1.5μm, 37% by weight of WC powder having an average particle diameter of 2 μm, and Ni powder and Co powder, 7% by weight each, both having an average particle diameter of 1.5 μm (e) 82% by weight of $(Ti_{0.7}, W_{0.3})(C_{0.7}, N_{0.3})$ powder, having an average particle diameter of 1.5 μm, 12% by weight of Ni powder having an average particle diameter of 1.5 μm, and 6% by weight of Co powder also having an average particle diameter of 1.5 μm (f) 49% by weight of $(Ti_{0.7}, W_{0.3})(C_{0.7}, N_{0.3})$ powder having an average particle diameter of 1.5μm, 37% by weight of WC powder having an average particle diameter of 2 μm, and Ni powder and Co powder, 7% by weight each, both having an average particle diameter of 1.5 μm.

These material powders were wet-mixed and molded by stamping to a predetermined shape. Then, they were heated under vacuum, sintered at 1400° C.–1550° C. in a carburizing or nitriding atmosphere, and cooled under vacuum. Specimens A-1–A-5, B-1–B-8, and C-1–C-6 were thus formed.

Table 16 shows the compressive residual stresses for Specimens A-1–A-5. Compressive residual stresses were measured by the X-ray compressive residual stress measuring method. We calculated stresses using the Young's modulus of 46000 and the Poisson's ratio of 0.23.

Specimens A-1–A-5 were subjected to cutting tests under the cutting conditions shown in Table 17 and evaluated for three items shown in Table 17. Test results are shown in Table 18.

Example 8

Table 19 shows the distribution of the binder phase in each of Specimens B-1–B-8.

Specimens B-1–B-8 were subjected to cutting tests under the conditions shown in Table 20 and evaluated for three items shown in Table 20. Test results are shown in Table 21.

Example 9

Table 22 shows the compressive residual stresses and the distribution of the binder phase for each of Specimens C-1–C-6.

Specimens C-1–C-6 were subjected to cutting tests under the conditions shown in Table 23 and evaluated for three items shown in Table 23. Test results are shown in Table 24.

TABLE 1

| | Binder phase rich layer | | | Binder | Hard phase | | | | |
|---|---|---|---|---|---|---|---|---|---|
| | | | | | in inner layer | | Hard phase in surface layer | | |
| Average binder phase content (wt %) | Max. binder phase content (wt %) | Depth at which content is max. (μm) | Thickness of rich layer (μm) | phase at surface layer (wt %) | Ti content | W content | Ti content | W content | Remarks |
| 9 | 15 Ratio to average content 1.67 | 56 | 180 | 5 Ratio to max. content 0.3 | 55 | 25 | 85 Ratio to inner 1.5 | 7 Ratio to inner 0.3 | WC particles deposit inside |

(Atomic % in hard phase)

TABLE 2

| | Binder phase | | | | | | | Hard phase | | | | | |
|---|---|---|---|---|---|---|---|---|---|---|---|---|---|
| | | | | | | | | | | Surface | | | |
| | Average | Portion where content is max. | | | Thickness of rich layer | Surface | | Inner | | | Ratio to inner | | |
| Specimen No. | content (wt %) ↓ | Content ↓ | Ratio to average ↓ | Depth (μm) ↓ | (μm) ↓ | content (wt %) ↓ | Ratio to max. | Ti (Atomic % in hard phase) ↓ | W ↓ | Ti ↓ | | W ↓ | Ratio to inner |
| 2 | 9 | 9 | 1.0* (Increase gradually from surface to inner) | 20* ~ | Inner* | 5 | 0.6* | 55 | 25 | 50 | 0.9* | 29 | 1.0* |
| 3 | 9 | 9 | 1.0* Uniform | —* | —* | 9 | 1.0* | 55 | 25 | 55 | 1.0* Uniform | 25 | 1.0* |
| 4 | 9 | 13 | 1.4 | 0* | 30 | 13 | 1.0* | 55 | 25 | 72 | 1.3 | 12 | 0.5 |

(*Out of the range of the present invention)

TABLE 3

| | Cutting condition 1 | Cutting condition 2 | Cutting condition 3 |
|---|---|---|---|
| Tool Shape | CNMG432 | CNMG432 | CNMG432 |
| Work piece | SCM435 (HB = 250) Round bar | SCM435 (HB = 250) Round bar with 4 longitudinal grooves | SCM435 (HB = 250) Round bar |
| Cutting speed | 200 m/min | 100 m/min | 250 m/min |
| Feed | 0.28 mm/rev. | 0.38 mm/rev. | 0.20 mm/rev |
| Depth of cut | 1.5 mm | 2.0 mm | 1.5→2.0 mm |
| Cutting oil | Water soluble | Not used | Water soluble |
| Cutting time | 15 min | 30 sec | 15 min |
| Judgement item | Wear on flank (mm) | Number of chipped edges among 20 cutting edges | Number of chipped edges among 20 cutting edges |

TABLE 4

| Specimen No. | | Cutting condition 1 Wear on flank (mm) | Cutting condition 2 Number of chipped edges among 20 cutting edges | Cutting condition 3 Number of chipped edges among 20 cutting edges |
|---|---|---|---|---|
| Present invention | 1 | 0.11 | 4 | 2 |
| Comparative example | 2 | 0.15 | 17 | 20 |
| | 3 | 0.24 | 10 | 12 |
| | 4 | 0.35 | 8 | 6 |

TABLE 5

| | | Binder phase | | | | | | | Hard phase | | | | | |
|---|---|---|---|---|---|---|---|---|---|---|---|---|---|---|
| | | | | | | | | | Inner | | Surface | | | |
| | | Average | Portion where content is max. | | | Thickness of | Surface | | Ti | | Ti | Ratio | | |
| | Specimen No. | content (wt %) ↓ | Content ↓ | Ratio to average | Depth (μm) ↓ | rich layer ↓ | Content (wt %) ↓ | Ratio to max. | + Ta ↓ | W ↓ | + Ta ↓ | to inner (Atomic % in hard phase) | W ↓ | Ratio to inner |
| Present invention | 5 | 11 | 14 | 1.3 | 140 | 360 | 6 | 0.43 | 68 | 21 | 77 | 1.13 | 13 | 0.62 |
| | 6 | 11 | 27 | 2.4 | 15 | 100 | 4 | 0.15 | 68 | 21 | 84 | 1.24 | 9 | 0.43 |
| Comparative example | 7 | 11 | 11.5 | 1.05* | 20 | 360 | 9 | 0.78 | 68 | 21 | 70 | 1.03 | 18 | 0.86 |
| | 8 | 11 | 15 | 1.36 | 85 | 250 | 9 | 0.6 | 68 | 21 | 68 | 1.0* Uniform | 21 | 1.0* |

(*Out of the range of the present invention)

TABLE 10

| | | Binder phase | | | | | | | Hard phase | | | | | |
|---|---|---|---|---|---|---|---|---|---|---|---|---|---|---|
| | | | | | | | | | Inner | | Surface | | | |
| | | Average | Portion where content is max. | | | Thickness of | Surface | | Ti + Ta | | Ti + Ta | Ratio | | |
| | Specimen No. | content (wt %) ↓ | Content ↓ | Ratio to average | Depth (μm) ↓ | rich layer ↓ | Content (wt %) ↓ | Ratio to max. | + Nb ↓ | W ↓ | + Nb ↓ | to inner (Atomic % in hard phase) | W ↓ | Ratio to inner |
| Present invention | 20 | 15 | 28 | 1.87 | 8 | 140 | 5 | 0.18 | 83 | 17 | 92 | 1.11 | 8 | 0.47 |
| Comparative example | 21 | 15 | 25 | 1.67 | 5 | 100 | 4 | 0.16 | 83 | 17 | 98.5 | 1.19 | 1.5 | 0.08* |
| | 22 | 15 | 21 | 1.4 | 0* | 20 | 21 | 1.0* | 83 | 17 | 94 | 1.13 | 6 | 0.35 |
| | 23 | 15 | 16 | 1.07* | 8 | 170 | 7 | 0.39 | 83 | 17 | 92 | 1.11 | 8 | 0.47 |
| | 24 | 15 | 25 | 1.67 | 2* | 10 | 9 | 0.36 | 83 | 17 | 97 | 1.17 | 3 | 0.18 |

(*Out of the range of the present invention)

TABLE 6

| | Cutting condition 4 | Cutting condition 5 |
|---|---|---|
| Tool shape | CNMG432 | CNMG432 |
| Work piece | SCM435 (HB = 250) Round bar | SCM435 (HB = 250) Round bar |
| Cutting speed | 180 m/min | 200 m/min |
| Feed | 0.25 mm/rev. | 0.20 mm/rev. |
| Depth of cut | 1.5 mm | 1.7→0.2 mm |
| Cutting oil | Water soluble | Water soluble |

TABLE 6-continued

| | Cutting condition 4 | Cutting condition 5 |
|---|---|---|
| Cutting time | 20 min | 15 min |
| Judgement item | Wear on flank (mm) | Number of chipped edges among 20 cutting edges |

TABLE 7

| Specimen No. | | Cutting condition 4 Wear on flank (mm) | Cutting condition 5 Number of chipped edges among 20 cutting edges |
|---|---|---|---|
| Present invention | 5 | 0.13 | 2 |
| | 6 | 0.11 | 3 |
| Comparative example | 7 | 0.16 | 18 |
| | 8 | 0.35 | 4 |

TABLE 8

| | | Binder phase | | | | | | | Hard phase | | | | | |
|---|---|---|---|---|---|---|---|---|---|---|---|---|---|---|
| | | Average content (wt %) | Portion where content is max. | | | Thickness of rich layer (μm) | Surface | | Inner | | Surface | | | |
| | Specimen No. | | Content | Ratio to average | Depth | | Content (wt %) | Ratio to max. | Ti + Nb (Atomic % in hard phase) | W | Ti + Nb | Ratio to inner | W | Ratio to inner |
| Present invention | 9 | 9 | 18 | 2.0 | 100 | 240 | 6 | 0.33 | 62 | 29 | 82 | 1.32 | 13 | 0.45 |
| | 10 | 9 | 27 | 3.0 | 85 | 450 | 4 | 0.15 | 62 | 29 | 79 | 1.27 | 15 | 0.52 |
| Comparative example | 11 | 11 | 12 | 1.09* | 20 | 130 | 3 | 0.25 | 65 | 21 | 77 | 1.18 | 8 | 0.38 |
| | 12 | 5 | 21 | 4.2* | 0* | 10 | 21 | 1.0* | 71 | 18 | 78 | 1.10 | 3 | 0.17 |
| | 13 | 15 | 18 | 1.2 | 8 | 118 | 4 | 0.22 | 68 | 21 | 92 | 1.35 | 2 | 0.09* |
| | 14 | 9 | 9.5 | 1.06* | 15 | 120 | 7 | 0.74 | 62 | 29 | 69 | 1.11 | 10 | 0.34 |
| | 15 | 9 | 38 | 4.22* | 5 | 35 | 22 | 0.58 | 62 | 29 | 75 | 1.21 | 8 | 0.28 |
| | 16 | 9 | 12 | 1.33 | 10 | 30 | 11 | 0.92* | 62 | 29 | 81 | 1.31 | 12 | 0.41 |
| | 17 | 9 | 18 | 2.0 | 120 | 110 | 7 | 0.74 | 62 | 29 | 82 | 1.0* | 27 | 0.93* |
| | 18 | 9 | 18 | 2.0 | 40 | 230 | 4 | 0.44 | 62 | 29 | 82 | 1.42 | 2 | 0.07* |
| | 19 | 9 | 15 | 1.67 | 2* | 10 | 6 | 0.67 | 62 | 29 | 82 | 1.32 | 13 | 0.45* |

(*Out of the range of the present invention)

TABLE 9

| | | | Cutting condition 6 | Cutting Condition 7 |
|---|---|---|---|---|
| Cutting conditions | Tool shape | | CNMG432 | CNMG432 |
| | Work piece | | SCM435 (HB = 250) Round bar | SCM435 (HB = 250) Round bar |
| | Cutting speed | | 220 m/min | 180 m/min |
| | Feed | | 0.25 mm/rev. | 0.21 mm/rev. |
| | Depth of cut | | 1.5 mm | 2.5→0.3 mm |
| | Cutting oil | | Water soluble | Water soluble |
| | Cutting time | | 10 min | 10 min |
| | Judgement item | | Wear on flank (mm) | Number of chipped edges among 20 cutting edges |
| Specimen No. | Present invention | 9 | 0.15 | 4 |
| | | 10 | 0.18 | 1 |
| | Comparative example | 11 | 0.16 | 10 |
| | | 12 | 0.48 | 18 |
| | | 13 | Chipped off in 5 min | 8 |
| | | 14 | 0.25 | 15 |
| | | 15 | 0.63 | 12 |
| | | 16 | 0.23 | 12 |
| | | 17 | 0.32 | 14 |
| | | 18 | Chipped off in 7 min | 6 |
| | | 19 | Over 0.8 mm in 5 min | 8 |

TABLE 11

| | | Cutting condition 8 | Cutting Condition 9 |
|---|---|---|---|
| Cutting conditions | Tool shape | CNMG432 | CNMG432 |
| | Work piece | SCM435 (HB = 250) Round bar | SCM435 (HB = 250) Round bar |
| | Cutting speed | 200 m/min | 200 m/min |
| | Feed | 0.32 mm/rev. | 0.21 mm/rev. |
| | Depth of cut | 1.5 mm | 1.5→0.1 mm |
| | Cutting oil | Water soluble | Water soluble |

TABLE 11-continued

| | | | Cutting condition 8 | Cutting Condition 9 |
|---|---|---|---|---|
| | Cutting time | | 15 min | 15 min |
| | Judgement item | | Wear on flank (mm) | Number of chipped edges among 20 cutting edges |
| Specimen No. | Present invention | 20 | 0.10 | 3 |
| | Comparative example | 21 | Chipped off in 13 min | 6 |
| | | 22 | Over 0.8 mm in 10 min | 8 |
| | | 23 | 0.23 | 14 |
| | | 24 | Chipped off in 10 min | 15 |

TABLE 13

| | | Cutting condition 10 | Cutting Condition 11 |
|---|---|---|---|
| Cutting conditions | Tool shape | CNMG432 | CNMG432 |
| | Work piece | SCM435 (HB = 250) Round bar | SCM435 (HB = 250) Round bar |
| | Cutting speed | 200 m/min | 250 m/min |
| | Feed | 0.25 mm/rev. | 0.22 mm/rev. |
| | Depth of cut | 1.5 mm | 2.5→0.2 mm |
| | Cutting oil | Water soluble | Water soluble |

TABLE 13-continued

| | | | Cutting condition 10 | Cutting Condition 11 |
|---|---|---|---|---|
| | Cutting time Judgement item | | 20 min Wear on flank (mm) | 10 min Number of chipped edges among 20 cutting edges |
| Specimen No. | Present invention | 25 | 0.15 | 2 |
| | | 26 | 0.11 | 3 |
| | Comparative example | 27 | 0.24 | 10 |
| | | 28 | Chipped off in 15 min | 18 |

TABLE 15-continued

| | | | Cutting condition 12 | Cutting Condition 13 |
|---|---|---|---|---|
| | Cutting time Judgement item | | 20 min Wear on flank (mm) | 20 min Number of chipped edges among 20 cutting edges |
| Specimen No. | Present invention | 29 | 0.13 | 3 |
| | Comparative example | 30 | 0.24 | 12 |

TABLE 12

| | | Binder phase | | | | | | | Hard phase | | | | | |
|---|---|---|---|---|---|---|---|---|---|---|---|---|---|---|
| | | Average content (wt %) | Portion where content is max. | | | Thickness of rich layer (μm) | Surface | | Inner | | Surface | | | |
| | Specimen No. | ↓ | Content ↓ | Ratio to average | Depth ↓ | ↓ | Content (wt %) ↓ | Ratio to max. | Ti + Zr ↓ | W ↓ | Ti + Zr ↓ | Ratio to inner | W ↓ | Ratio to inner |
| | | | | | | | | | (Atomic % in hard phase) | | | | | |
| Present invention | 25 | 12 | 28 | 2.33 | 60 | 140 | 6 | 0.21 | 72 | 19 | 82 | 1.14 | 6 | 0.32 |
| | 26 | 9 | 27 | 3.0 | 95 | 245 | 5 | 0.19 | 68 | 24 | 79 | 1.16 | 15 | 0.63 |
| Comparative example | 27 | 12 | 12 | 1.0* | 0* | 160 | 12 | 1.0* | 70 | 21 | 77 | 1.10 | 8 | 0.38 |
| | 28 | 9 | 21 | 2.33 | 10 | 120 | 7 | 0.33 | 58 | 35 | 83 | 1.43 | 3 | 0.08* |

(*Out of the range of the present invention)

TABLE 14

| | | Binder phase | | | | | | | Hard phase | | | | | |
|---|---|---|---|---|---|---|---|---|---|---|---|---|---|---|
| | | Average content (wt %) | Portion where content is max. | | | Thickness of rich layer (μm) | Surface | | Inner | | Surface | | | |
| | Specimen No. | ↓ | Content ↓ | Ratio to average | Depth ↓ | ↓ | Content (wt %) ↓ | Ratio to max. | Ti ↓ | W + Mo ↓ | Ti ↓ | Ratio to inner | W + Mo ↓ | Ratio to inner |
| | | | | | | | | | (Atomic % in hard phase) | | | | | |
| Present inventive | 29 | 14 | 28 | 2.0 | 15 | 40 | 7 | 0.25 | 61 | 29 | 82 | 1.34 | 6 | 0.21 |
| Comparative example | 30 | 13 | 14 | 1.08* | 20 | 60 | 11 | 0.79 | 70 | 24 | 75 | 1.07 | 8 | 0.33 |

(*Out of the range of the present invention)

TABLE 15

| | | Cutting condition 12 | Cutting Condition 13 |
|---|---|---|---|
| Cutting conditions | Tool shape | CNMG432 | CNMG432 |
| | Work piece | SCM435 (HB = 250) Round bar | SCM435 (HB = 250) Round bar |
| | Cutting speed | 120 m/min | 150 m/min |
| | Feed | 0.29 mm/rev. | 0.28 mm/rev. |
| | Depth of cut | 1.5 mm | 1.5→0.2 mm |
| | Cutting oil | Water soluble | Water soluble |

TABLE 16

| Specimen No. | Material | Compressive residual stress: Compressive residual stress at surface ($kg/mm^2$) | Max. compressive residual stress ($kg/mm^2$) | / / / | Distance from surface (μm) |
|---|---|---|---|---|---|
| A-1* | (a) | 11 | 11 | / | 0 |
| A-2* | (c) | 32 | 32 | / | 0 |
| A-3 | (a) | 54 | 54 | / | 0 |
| A-4 | (e) | 54 | 66 | / | 25 |
| A-5* | (a) | 0 | 0 | / | 0 |

*Out of the range of the present invention

TABLE 17

| | Cutting condition 1 (lathing) | Cutting condition 2 (lathing) | Cutting condition 3 (milling) |
|---|---|---|---|
| Tool Shape | CNMG432 | CNMG432 | CNMG432 |
| Work piece | SCM435 (HB = 250) Round bar | SCM435 (HB = 250) Round bar with 4 longitudinal grooves | SCM435 (HB = 250) Round bar |
| Cutting speed | 180 (m/min) | 110 (m/min) | 160 (m/min) |
| Feed | 0.30 (mm/rev.) | 0.30 (mm/rev.) | 0.28 (mm/rev) |
| Depth of cut | 1.5 (mm) | 2.0 (mm) | 2.0 (mm) |
| Cutting oil | Water soluble | Not used | Water soluble |
| Cutting time | 15 (min) | 30 (sec) | 5 passes |
| Judgement item | Wear on flank (mm) | Number of chipped edges among 20 cutting edges | Total number of thermal cracks among 20 cutting edges |

TABLE 18

| Specimen No. | Cutting condition 1 Wear (mm) | Cutting condition 2 Number of chipped edges | Cutting condition 3 Number of thermal cracks |
|---|---|---|---|
| A-1* | 0.28 | 11 | 72 |
| A-2* | 0.24 | 8 | 65 |
| A-3 | 0.14 | 3 | 4 |
| A-4 | 0.13 | 0 | 2 |
| A-5* | 0.36 | 18 | 140 |

*Out of the range of the present invention

TABLE 19

| Specimen No. | Material | Structure: Binder phase content at surface (vol %) | Width of area where binder phase content is constant at not more than 5 vol % (μm) | Increment of binder phase content per unit distance (vol %/μm) |
|---|---|---|---|---|
| B-1* | (a) | 7 | None | 0.02 |
| B-2 | (c) | 3 | None | 0.02 |
| B-3 | (e) | 3 | 4 | 0.03 |
| B-4 | (c) | 3 | 8 | 0.07 |
| B-5 | (a) | 0 | None | 0.03 |
| B-6 | (a) | 0 | 10 | 0.04 |
| B-7 | (a) | 0 | 15 | 0.09 |
| B-8* | (a) | 14 | None | 0 |

*Out of the range of the present invention

TABLE 20

| | Cutting condition 1 (lathing) | Cutting condition 2 (lathing) | Cutting condition 3 (milling) |
|---|---|---|---|
| Tool Shape | CNMG432 | CNMG432 | CNMG432 |
| Work piece | SCM435 (HB = 250) Round bar | SCM435 (HB = 250) Round bar with 4 longitudinal grooves | SCM435 (HB = 250) Plate with 3 grooves |
| Cutting speed | 200 (m/min) | 100 (m/min) | 180 (m/min) |
| Feed | 0.36 (mm/rev.) | 0.32 (mm/rev.) | 0.24 (mm/edge) |
| Depth of cut | 1.5 (mm) | 1.8 (mm) | 2.0 (mm) |
| Cutting oil | Water soluble | Not used | Water soluble |
| Cutting time | 10 (min) | 30 (sec) | 5 passes |
| Judgement item | Wear on flank (mm) | Number of chipped edges among 20 cutting edges | Total number of thermal cracks among 20 cutting edges |

TABLE 21

| Specimen No. | Cutting condition 1 Wear (mm) | Cutting condition 2 Number of chipped edges | Cutting condition 3 Number of thermal cracks |
|---|---|---|---|
| B-1 | 0.25 | 15 | 101 |
| B-2 | 0.17 | 10 | 80 |
| B-3 | 0.12 | 8 | 53 |
| B-4 | 0.10 | 4 | 13 |
| B-5 | 0.10 | 8 | 29 |
| B-6 | 0.08 | 6 | 22 |
| B-7 | 0.06 | 3 | 4 |
| B-8* | 0.28 | 19 | 133 |

*Out of the range of the present invention

TABLE 22

Compressive residual stress

| Specimen No. | Material | Compressive residual stress at surface ($kg/mm^2$) | Max. compressive residual stress ($kg/mm^2$) | Distance from surface of point where compressive residual stress is max. (μm) |
|---|---|---|---|---|
| C-1 | (a) | 80 | 90 | 10 |
| C-2 | (b) | 75 | 85 | 10 |
| C-3* | (c) | 0 | 0 | 0 |
| C-4 | (d) | 0 | 0 | 0 |
| C-5 | (e) | 65 | 65 | 0 |
| C-6 | (f) | 60 | 60 | 0 |

Structure

| Specimen No. | Binder phase content at surface (vol %) | Width of area where binder phase content is constant at not more than 5 vol % (μm) | Increment of binder phase content per unit distance (vol %/μm) |
|---|---|---|---|
| C-1 | 0 | 10 | 0.10 |
| C-2 | 0 | 10 | 0.10 |
| C-3* | 12 | None | 0 |
| C-4 | 12 | None | 0 |
| C-5 | 3 | None | 0.06 |
| C-6 | 3 | None | 0.06 |

Behavior of WC particles from surface area to inner area

| | |
|---|---|
| C-1 | Not present |
| C-2 | 2 vol % at surface, gradually increase with depth, become constant at depth of 100 μm |
| C-3* | Not present |
| C-4 | 3 vol % at surface, gradually increase with depth, become constant at depth of 100 μm |
| C-5 | Not present |
| C-6 | 3 vol % at surface, gradually increase with depth, become constant at depth of 100 μm |

*Out of the range of the present invention

TABLE 23

| | Cutting condition 1 (lathing) | Cutting condition 2 (lathing) | Cutting condition 3 (milling) |
|---|---|---|---|
| Tool Shape | CNMG432 | CNMG432 | CNMG432 |
| Work piece | SCM435 (HB = 250) Round bar | SCM435 (HB = 250) Round bar with 4 longitudinal grooves | SCM435 (HB = 250) Plate with 3 grooves |
| Cutting speed | 210 (m/min) | 120 (m/min) | 180 (m/min) |
| Feed | 0.36 (mm/rev.) | 0.32 (mm/rev.) | 0.24 (mm/edge) |
| Depth of cut | 1.5 (mm) | 1.8 (mm) | 2.5 (mm) |
| Cutting oil | Water soluble | Not used | Water soluble |
| Cutting time | 8 (min) | 30 (sec) | 5 passes |
| Judgement item | Wear on flank (mm) | Number of chipped edges among 20 cutting edges | Total number of thermal cracks among 20 edges |

TABLE 24

| Specimen No. | Cutting condition 1 Wear (mm) | Cutting condition 2 Number of chipped edges | Cutting condition 3 Number of thermal cracks |
|---|---|---|---|
| C-1 | 0.16 | 3 | 11 |
| C-2 | 0.19 | 0 | 6 |
| C-3* | 0.37 | 19 | 121 |
| C-4 | 0.39 | 11 | 95 |
| C-5 | 0.22 | 8 | 52 |
| C-6 | 0.23 | 4 | 26 |

*Out of the range of the present invention

We claim:

1. A nitrogen-containing sintered hard alloy comprising:

a hard phase selected from the group consisting of:

i) a hard phase made up of composite carbonitrides of Ti and at least one transition metal selected from Group IVb, Vb, and VIb metals of the Periodic Table except Ti; and ii) a hard phase which is a combination of a first hard phase made up of composite carbonitrides of Ti and at least one transition metal selected from Group IVb, Vb, and VIb metals of the Periodic Table except Ti, and a second hard phase made up of at least one of carbides, nitrides and carbonitrides of at least one transition metal selected from Group IVb, Vb and VIb metals of the Periodic Table; and a binder phase containing Ni, Co and inevitable impurities, wherein an area where the content of said binder phase becomes maximum exists in the region of depth of 3 μm to 500 μm from the surface; the maximum value of the binder phase content in weight percent is 1.1 to 4 times the average content of said binder phase in the entire alloy; said binder phase content decreases to said average content before the depth reaches 800 μm; the content of binder phase at the surface does not exceed 0.9 time said maximum value;

said hard phase has a composition represented by ($Ti_xW_yM_c$) (where M is a hard phase-forming transition metal other than Ti and W, and x, y and c are atomic ratios and satisfy the relation x+y+c=1 (0.5<x≦0.95, 0.05<y 0.5));

x at the surface is 1.01 times or more the average x in the entire alloy, and y at the surface is 0.1 to 0.9 time the average y in the entire alloy; the values x and y at the surface return to said average x and y, respectively, before the depth reaches 800 μm; and WC particles do not exist at all or exist in the amount of not more than 0.1% by volume at the surface.

2. A nitrogen-containing sintered hard alloy comprising:

a hard phase selected from the group consisting of:

i) a hard phase made up of composite carbonitrides of Ti and at least one transition metal selected from Group IVb, Vb, and VIb metals of the Periodic Table except Ti; and ii) a hard phase which is a combination of a first hard phase made up of composite carbonitrides of Ti and at least one transition metal selected from Group IVb, Vb, and VIb metals of the Periodic Table except Ti, and a second hard phase made up of at least one of carbides, nitrides and carbonitrides of at least one transition metal selected from Group IVb, Vb and VIb metals of the Periodic Table; and a binder phase containing Ni, Co and inevitable impurities, wherein an area where the content of said binder phase becomes maximum exists in the region of depth of 3 μm to 500 μm from the surface; the maximum value of the binder phase content in weight percent is 1.1 to 4 times the average content of the binder phase in the entire alloy;

said maximum binder phase content decreases to said average value before the depth reaches 800 μm; the content of binder phase at the surface does not exceed 0.9 time said maximum value;

said hard phase has a composition represented by ($Ti_xW_yM'_bM_c$) (where M is a hard phase-forming transition metal other than Ti, W, Ta and Nb, M' is selected from Ta and Nb, and x, y, b and c are atomic ratios and satisfy the relation x+y+b+c=1 (0.5<x ≦0.95, 0.05<y≦0.5, 0.01<b 0.4));

x+b at the surface is 1.01 times or more the average (x+b) in the entire alloy, and y at the surface is 0.1 to 0.9 time the average y in the entire alloy; the values (x+b) and y at the surface return to said average (x+b) and y, respectively, before the depth reaches 800 μm; and WC particles do not exist at all or exist in the amount of not more than 0.1% by volume at the surface.

3. A nitrogen-containing sintered hard alloy comprising:

a hard phase selected from the group consisting of:

i) a hard phase made up of composite carbonitrides of Ti and at least one transition metal selected from Group IVb, Vb, and VIb metals of the Periodic Table except Ti; and ii) a hard phase which is a combination of a first hard phase made up of composite carbonitrides of Ti and at least one transition metal selected from Group IVb, Vb, and VIb metals of the Periodic Table except Ti, and a second hard phase made up of at least one of carbides, nitrides and carbonitrides of at least one transition metal selected from Group IVb, Vb and VIb metals of the Periodic Table; and a binder phase containing Ni, Co and inevitable impurities, wherein an area where the content of said binder phase becomes maximum exists in the region of depth of 3 μm to 500 μm from the surface; the maximum value of the binder phase content in weight percent is 1.1 to 4 times the average content of said binder phase in the entire alloy;

said maximum binder phase content decreases to said average value before the depth reaches 800 μm; the content of binder phase at the surface does not exceed 0.9 time said maximum value;

the hard phase has a composition represented by $(Ti_xW_yTa_aNb_bM_c)$ (where M is a hard phase-forming transition metal other than Ti, W, Ta and Nb, and x, y, a, b and c are atomic ratios and satisfy the relation $x+y+a+b+c=1$ $(0.5<x\leqq0.95, 0.05<y\leqq0.5, 0.01<a\leqq0.4, 0.01<b\leqq0.4)$);

(x+a+b) at the surface is 1.01 times or more the average (x+a+b) in the entire alloy, and y at the surface is between 0.1 to 0.9 time the average y in the entire alloy; the values (x+a+b) and y at the surface return to said average values (x+a+b) and y, respectively, before the depth reaches 800 m; and WC particles do not exist at all or exist in the amount of not more than 0.1% by volume at the surface.

4. A nitrogen-containing sintered hard alloy comprising:

a hard phase selected from the group consisting of:

i) a hard phase made up of composite carbonitrides of Ti and at least one transition metal selected from Group IVb, Vb, and VIb metals of the Periodic Table except Ti; and ii) a hard phase which is a combination of a first hard phase made up of composite carbonitrides of Ti and at least one transition metal selected from Group IVb, Vb, and VIb metals of the Periodic Table except Ti, and a second hard phase made up of at least one of carbides, nitrides and carbonitrides of at least one transition metal selected from Group IVb, Vb and VIb metals of the Periodic Table; and a binder phase containing Ni, Co and inevitable impurities, wherein an area where the content of said binder phase becomes maximum exists in the region of depth of 3 μm to 500 μm from the surface; the maximum value of the binder phase content in weight percent is 1.1 to 4 times the average content of said binder phase in the entire alloy;

said maximum binder phase content decreases to said average value before the depth reaches 800 μm; the content of binder phase at the surface does not exceed 0.9 time said maximum value;

said hard phase has a composition represented by $(Ti_xW_yZr_bM_c)$ (where M is a hard phase-forming transition metal other than Ti, W and Zr, and x, y, b and c are atomic ratios and satisfy the relation $x+y+b+c=1$ $(0.5<x\leqq0.95, 0.05<y\leqq0.5, 0.01<b\leqq0.4)$);

(x+b) at the surface is 1.01 times or more the average (x+b) in the entire alloy, and y at the surface is 0.1 to 0.9 time the average y in the entire alloy; the values (x+b) and y at the surface return to said average values (x+b) and y, respectively, before the depth reaches 800 μm; and WC particles do not exist at all or exist in the amount of not more than 0.1% by volume at the surface.

5. A nitrogen-containing sintered hard alloy comprising:

a hard phase selected from the group consisting of:

i) a hard phase made up of composite carbonitrides of Ti and at least one transition metal selected from Group IVb, Vb, and VIb metals of the Periodic Table except Ti; and ii) a hard phase which is a combination of a first hard phase made up of composite carbonitrides of Ti and at least one transition metal selected from Group IVb, Vb, and VIb metals of the Periodic Table except Ti, and a second hard phase made up of at least one of carbides, nitrides and carbonitrides of at least one transition metal selected from Group IVb, Vb and VIb metals of the Periodic Table; and a binder phase containing Ni, Co and inevitable impurities, wherein an area where the content of said binder phase becomes maximum exists in the region of depth of 3 μm to 500 μm from the surface; the maximum value of the binder phase content in weight percent is 1.1 to 4 times the average content of said binder phase in the entire alloy;

said maximum binder phase content decreases to said average value before the depth reaches 800 μm; the content of binder phase at the surface does not exceed 0.9 time said maximum value;

said hard phase has a composition represented by $(Ti_xW_yMo_bM_c)$ (where M is a hard phase-forming transition metal other than Ti, W and Mo, and x, y, b and c are atomic ratios and satisfy the relation $x+y+b+c=1$ $(0.5<x\leqq0.95, 0.05<y\leqq0.5, 0.01<b<0.4)$);

x at the surface is 1.01 times or more the average x in the entire alloy, and (y+b) at the surface is 0.1 to 0.9 time the average (y+b) in the entire alloy; the values x and (y+b) at the surface return to said average values x and (y+b), respectively, before the depth reaches 800 μm; and WC particles do not exist at all or exist in the amount of not more than 0.1% by volume at the surface.

6. A nitrogen-containing sintered hard alloy comprising:

a hard phase selected from the group consisting of:

i) a hard phase made up of composite carbonitrides of Ti and at least one transition metal selected from Group IVb, Vb, and VIb metals of the Periodic Table except Ti; and ii) a hard phase which is a combination of a first hard phase made up of composite carbonitrides of Ti and at least one transition metal selected from Group IVb, Vb, and VIb metals of the Periodic Table except Ti, and a second hard phase made up of at least one of carbides, nitrides and carbonitrides of at least one transition metal selected from Group IVb, Vb and VIb metals of the Periodic Table; and a binder phase containing Ni, Co and inevitable impurities, wherein the compressive residual stress in a hard phase having the crystal structure of NaCl type is 40 kg/mm2 or more at the surface.

7. A nitrogen-containing sintered hard alloy comprising:

a hard phase selected from the group consisting of:

i) a hard phase made up of composite carbonitrides of Ti and at least one transition metal selected from Group IVb, Vb, and VIb metals of the Periodic Table except Ti; and ii) a hard phase which is a combination of a first hard phase made up of composite carbonitrides of Ti and at least one transition metal selected from Group IVb, Vb, and VIb metals of the Periodic Table except Ti, and a second hard phase made up of at least one of carbides, nitrides and carbonitrides of at least one transition metal selected from Group IVb, Vb and VIb metals of the Periodic Table; and a binder phase containing Ni, Co and inevitable impurities, wherein a hard phase having the crystal structure of NaCl type and having a compressive residual stress 1.01 times or more than the compressive residual stress at the surface exists in the region of depth of 1 μm to 100 μm from the surface.

8. A nitrogen-containing sintered hard alloy as claimed in claim 7 wherein said hard phase having the crystal structure of NaCl type in said region has a compressive residual stress of 40 kg/mm$^2$ or more.

9. A nitrogen-containing sintered hard alloy comprising:

a hard phase selected from the group consisting of:

i) a hard phase made up of composite carbonitrides of Ti and at least one transition metal selected from Group IVb, Vb, and VIb metals of the Periodic Table except Ti; and ii) a hard phase which is a combination of a first hard phase made up of composite carbonitrides of Ti and at least one transition metal selected from Group IVb, Vb, and VIb metals of the Periodic Table except Ti, and a second hard phase made up of at least one of carbides, nitrides and carbonitrides of at least one transition metal selected from Group IVb, Vb and VIb metals of the Periodic Table; and a binder phase containing Ni, Co and inevitable impurities, wherein the content of said binder phase is not more than 5% by volume in a region from the surface of the alloy to a depth of between 1 μm and 100 μm, and wherein the content of said binder phase is between 10% by volume and 20% by volume at a depth of 800 μm from the surface of the alloy.

10. A nitrogen-containing sintered alloy as claimed in claim 9 wherein a region from the surface to the depth of between 1 μm and 50 μm contains the binder phase in the amount of between zero and one percent by volume.

11. A nitrogen-containing sintered hard alloy as claimed in claim 9 or 10 further having a structure wherein said alloy has a region in which the content of said binder phase increases gradually inwards from the surface of the alloy, and the maximum content gradient of the binder phase in said region in the direction of depth (the rate at which the binder phase content increases per micrometer) is 0.05% by volume.

12. A nitrogen-containing sintered hard alloy as claimed in claim 11 having a structure wherein said alloy contains WC particles, the content of said WC particles increasing gradually inwards from the surface of the alloy and becoming equal to the average WC content in volume percentage in the entire alloy at a depth of 500 μm or less.

13. A nitrogen-containing sintered alloy as claimed in claim 9 or 10 wherein the content of said binder phase is constant in a region from the surface to the depth of between 1 μm and 30 μm.

14. A nitrogen-containing sintered hard alloy as claimed in claim 13 further having a structure wherein said alloy has a region in which the content of said binder phase increases gradually inwards from the surface of the alloy, and the maximum content gradient of the binder phase in said region in the direction of depth (the rate at which the binder phase content increases per micrometer) is 0.05% by volume.

15. A nitrogen-containing sintered hard alloy as claimed in claim 14 further having a structure wherein said alloy contains WC particles, the content of said WC particles increasing gradually inwards from the surface of the alloy and becoming equal to the average WC content in volume percentage in the entire alloy at a depth of 500 μm or less.

16. A nitrogen-containing sintered hard alloy as claimed in claim 13 further having a structure wherein said alloy contains WC particles, the content of said WC particles increasing gradually inwards from the surface of the alloy and becoming equal to the average WC content in volume percentage in the entire alloy at a depth of 500 μm or less.

17. A nitrogen-containing sintered hard alloy comprising:

a hard phase selected from the group consisting of:

i) a hard phase made up of composite carbonitrides of Ti and at least one transition metal selected from Group IVb, Vb, and VIb metals of the Periodic Table except Ti; and ii) a hard phase which is a combination of a first hard phase made up of composite carbonitrides of Ti and at least one transition metal selected from Group IVb, Vb, and VIb metals of the Periodic Table except Ti, and a second hard phase made up of at least one of carbides, nitrides and carbonitrides of at least one transition metal selected from Group IVb, Vb and VIb metals of the Periodic Table; and a binder phase containing Ni, Co and inevitable impurities, wherein said alloy has a region in which the content of said binder phase increases gradually inwards from the surface of the alloy, and the maximum content gradient of the binder phase in said region in the direction of depth (the rate at which the binder phase content increases per micrometer) is 0.05% by volume.

18. A nitrogen-containing sintered hard alloy as claimed in any of claims 10 or 17 further having a structure wherein said alloy contains WC particles, the content of said WC particles increasing gradually inwards from the surface of the alloy and becoming equal to the average WC content in volume percentage in the entire alloy at a depth of 500 μm or less.

19. A nitrogen-containing sintered hard alloy comprising:

a hard phase selected from the group consisting of:

i) a hard phase made up of composite carbonitrides of Ti and at least one transition metal selected from Group IVb, Vb, and VIb metals of the Periodic Table except Ti; and ii) a hard phase which is a combination of a first hard phase made up of composite carbonitrides of Ti and at least one transition metal selected from Group IVb, Vb, and VIb metals of the Periodic Table except Ti, and a second hard phase made up of at least one of carbides, nitrides and carbonitrides of at least one transition metal selected from Group IVb, Vb and VIb metals of the Periodic Table; and a binder phase containing Ni, Co and inevitable impurities, wherein said alloy contains WC particles, the content of said WC particles increasing gradually inwards from the surface of the alloy and becoming equal to the average WC content in volume percentage in the entire alloy at a depth of 500 μm or less.

* * * * *